US005642465A

United States Patent [19]

Scott et al.

[11] Patent Number: 5,642,465

[45] Date of Patent: Jun. 24, 1997

[54] LINEAR PREDICTION SPEECH CODING METHOD USING SPECTRAL ENERGY FOR QUANTIZATION MODE SELECTION

[75] Inventors: Sophie Scott, Paris; William Navarro, Velizy Villacoublay, both of France

[73] Assignee: Matra Communication, Quimper, France

[21] Appl. No.: 465,263

[22] Filed: Jun. 5, 1995

[30] Foreign Application Priority Data

Jun. 3, 1994 [FR] France ..... 94 06825

[51] Int. Cl.[6] ..... G10L 3/00

[52] U.S. Cl. ..... 395/2.29; 395/2.28; 395/2.32; 395/2.35; 395/2.42

[58] Field of Search ..... 395/2.7, 2.28, 395/2.29, 2.32, 2.33, 2.34, 2.35

[56] References Cited

PUBLICATIONS

International Conference on Acoustics, Speech and Signal Processing 92, vol. 1, May 1991, Toronto—"A robust 440–bps speech coder against backgroung noise", LIU–pp. 601–604.

International Conference on Acoustics, Speech and Signal Processing 93, vol. 2, Apr. 1993, Minneapolis—"Vector quantized MBE with simplified v/UV division at 3.0 kbps", Nishiguchi et al–pp. 151–154.

International Conference on Acoustics, Speech and Signal Processing 85, vol. 3, Mar. 185, Tampa—"Code–excited linear prediction (CElP): high–quality speech at very low bit rates", Schroeder et al–pp. 937–940

*Primary Examiner*—Allen R. MacDonald
*Assistant Examiner*—Alphonso A. Collins
*Attorney, Agent, or Firm*—Larson and Taylor

[57] ABSTRACT

A speech signal digitized as successive frames is subjected to analysis-by-synthesis in order to obtain, for each frame, quantization values of synthesis parameters allowing reconstruction of an estimate of the speech signal. The analysis-by-synthesis includes short-term linear prediction of the speech signal in order to determine the quantization values of the coefficients of a short-term synthesis filter. A spectral state of the speech signal is determined from among first and second states such that the signal contains proportionally less energy at the low frequencies in the first state than in the second state, and one or the other of two modes of quantization is applied to obtain the quantization values of the coefficients of the short-term synthesis filter depending on the determined spectral state of the speech signal.

13 Claims, 4 Drawing Sheets

CORR. MAX.
EXCITATION GENERATOR
MAX.
CORR.
ADC
A(Z)
SHORT TERM PREDICTION
SPECTRAL STATE DETECTION
RESTORING OF QUANTIZED PARAMETERS
EXCITATION GENERATOR

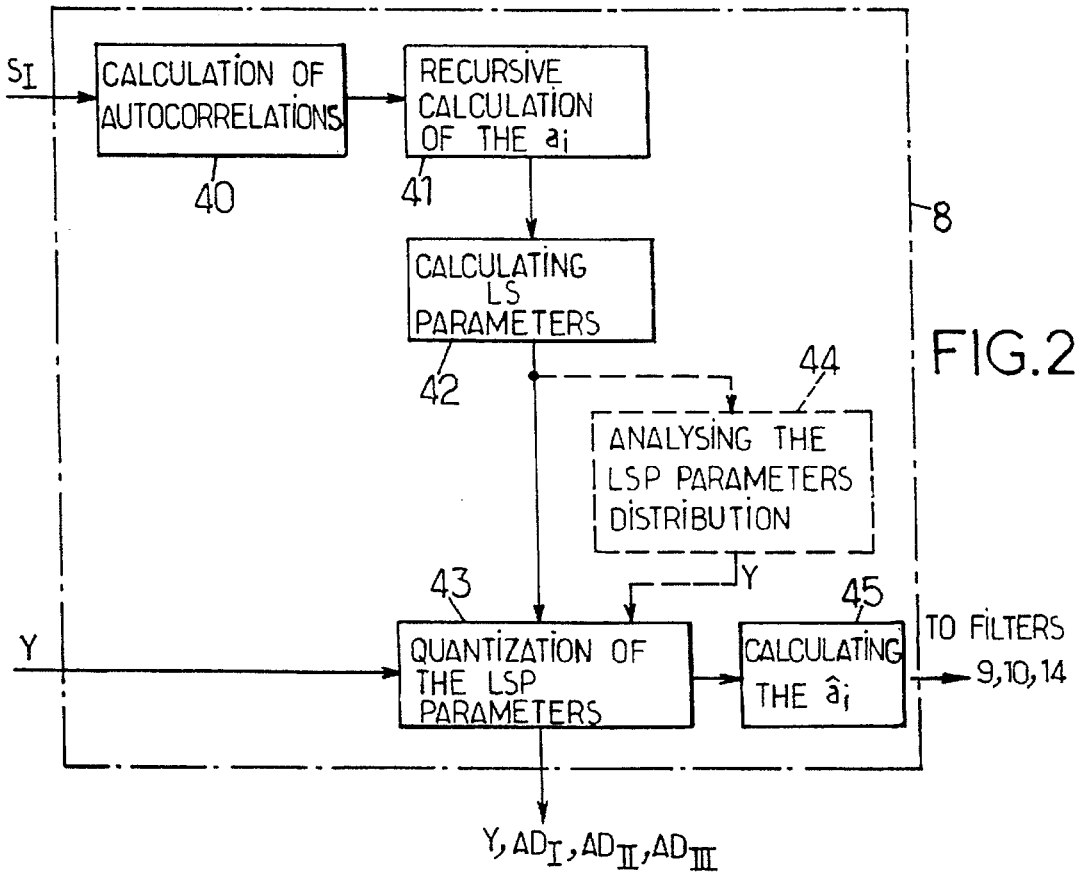
FIG.2.
FIG.3.
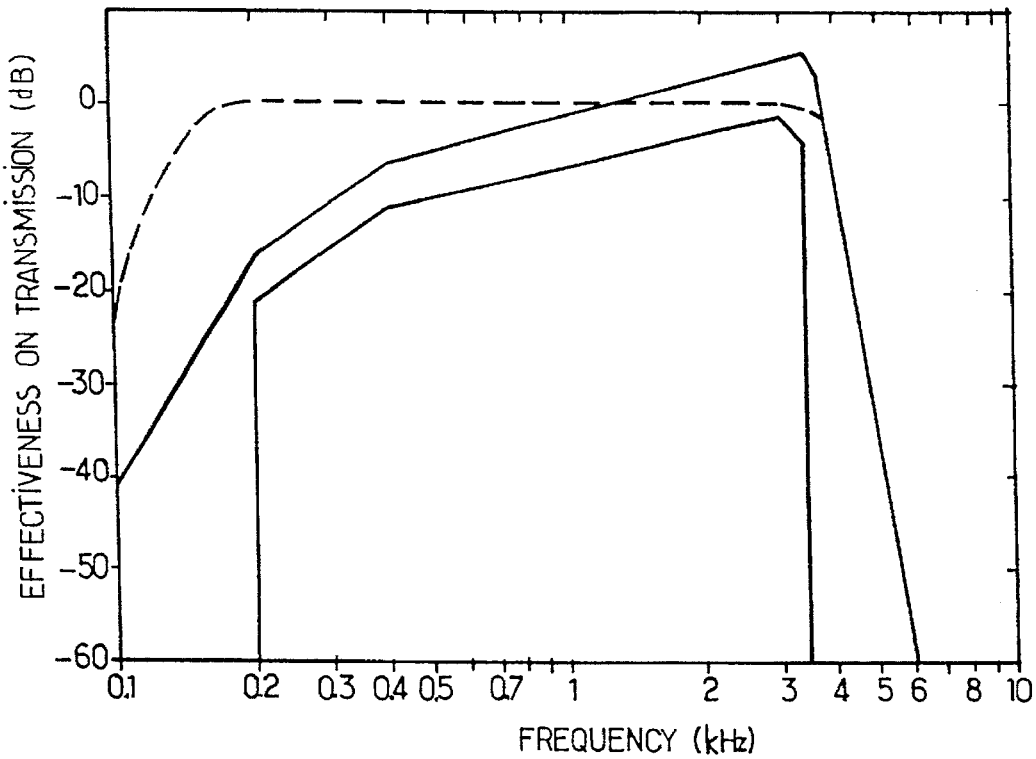

LINEAR PREDICTION SPEECH CODING METHOD USING SPECTRAL ENERGY FOR QUANTIZATION MODE SELECTION

BACKGROUND OF THE INVENTION

The present invention relates to a linear prediction speech coding method, in which a speech signal digitized as successive frames is subjected to analysis-by-synthesis in order to obtain, for each frame, quantization values of synthesis parameters allowing reconstruction of an estimate of the speech signal, the analysis-by-synthesis comprising short-term linear prediction of the speech signal in order to determine the coefficients of a short-term synthesis filter.

The present-day speech coders with low bit rate (typically 5 kbit/s for a sampling frequency of 8 kHz) yield their best performance on signals exhibiting a "telephone" spectrum, that is to say one in the 300–3400 Hz band and with pre-emphasis in the high frequencies. These spectral characteristics correspond to the IRS (Intermediate Reference System) template defined by the CCITT in Recommendation P48. This template has been defined for telephone handsets, both for input (microphone) and output (ear pieces).

However, it happens more and more frequently that the input signal of a speech coder exhibits a "flatter" spectrum, for example when a hands-free installation is used, employing a microphone with linear frequency response. Conventional vocoders are designed to be independent of the input with which they operate, and, besides, they are not informed of the characteristics of this input. If microphones with different characteristics are likely to be connected up to the vocoder, or more generally if the vocoder is likely to receive acoustic signals exhibiting different spectral characteristics, there are cases in which the vocoder is used in a sub-optimal manner.

In this context, a main purpose of the present invention is to improve a vocoder's performance, by rendering it less dependent on the spectral characteristics of the input signal.

SUMMARY OF THE INVENTION

The invention proposes a method of speech coding of the type indicated at the start, in which a spectral state of the speech signal is determined from among first and second states such that the signal contains proportionally less energy at the low frequencies in the first state than in the second state, and one or the other of two modes of quantization is applied to obtain the quantization values of the coefficients of the short-term synthesis filter depending on the determined spectral state of the speech signal.

Thus, detection of the spectral state makes it possible to adapt the coder to the characteristics of the input signal. The performance of the coder can be improved or, for identical performance, the number of bits required for the coding can be reduced.

Preferably, the coefficients of the short-term synthesis filter are represented by a set of p ordered line spectrum frequency parameters, termed "LSP parameters", p being the order of the linear prediction. The distribution of these p LSP parameters can be analyzed in order to advise on the spectral state of the signal and contribute to the detection of this state.

The LSP parameters may be subjected to scalar or vector quantization. In the case of scalar quantization, the i-th LSP parameter is quantized by subdividing an interval of variation included within a respective reference interval into $2^{Ni}$ segments, Ni being the number of coding bits devoted to the quantizing of this parameter. A first possibility is to use at least for the first ordered LSP parameters, reference intervals each chosen from among two distinct intervals depending on the determined spectral state of the speech signal. A further possibility is to give at least some of the numbers of coding bits Ni one or the other of two distinct values depending on the determined spectral state of the speech signal, in order to perform dynamic bit allocations.

In the case of direct vector quantization, the set of p ordered LSP parameters is subdivided into m groups of consecutive parameters, and at least the first group can be quantised by selecting from a quantization table a vector exhibiting a minimum distance from the LSP parameters of the said group, this table being chosen from among two distinct quantization tables depending on the determined spectral state of the speech signal.

In the case of differential vector quantization, the set of p ordered LSP parameters is subdivided into m groups of consecutive parameters and, at least for the first group, differential quantization can be performed relative to a mean vector chosen from among two distinct vectors depending on the determined spectral state of the speech signal.

BRIEF DESCRIPTION OF THE DRAWINGS

FIG. 2 is a schematic diagram of a linear prediction unit useable in the coder of FIG. 1A.

FIG. 3 is a chart illustrating the characteristics of an acoustic signal of IRS type and of a signal of linear type.

DESCRIPTION OF PREFERRED EMBODIMENTS

Figures 1A, 1B:
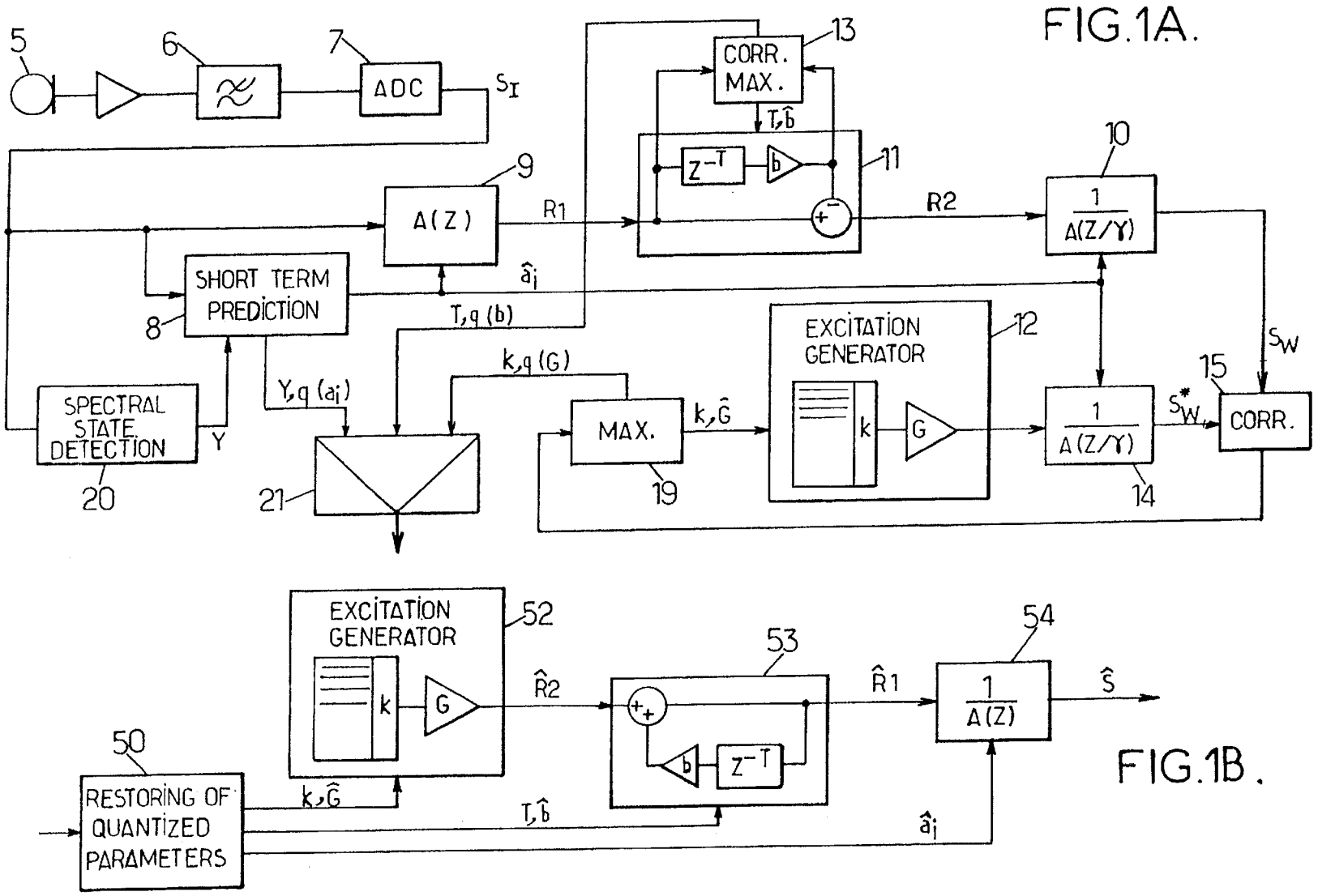
FIGS. 1A and 1B are schematic diagrams respectively of an analysis-by-synthesis speech coder for the implementation of the invention and of an associated decoder.

The speech coder illustrated in FIG. 1A rests on the principle of analysis-by-synthesis. Its general organization is conventional except as regards the short-term prediction unit 8 and the unit 20 for detecting the spectral state of the signal.

The speech coder processes the amplified output signal from a microphone 5. A low-pass filter 6 eliminates the frequency components of this signal above the upper limit (for example 4000 Hz) of the pass-band processed by the coder. The signal is next digitalized by the analog/digital converter 7 which delivers the input signal $S_I$ in the form of successive frames of 10 to 30 ms consisting of samples taken at a rate of 8,000 Hz for example.

Analysis-by-synthesis rests on a modelling of the vocal tract of the speaker by an all-pole filter with transfer function H(z)=1/A(z) where $$A(z) = 1 - \sum_{i=1}^{p} a_i z^{-i}$$

The coefficients $a_i$ of this filter ($1 \leqq i \leqq p$) can be obtained by short-term linear prediction of the input signal, the number p denoting the order of the linear prediction, which is typically equal to 10 for narrow-band speech. The short-term prediction unit 8 determines estimates $\hat{a}_i$ of the coefficients $a_i$ which correspond to a quantization of these coefficients by quantization values $q(a_i)$.

Each input signal frame $S_I$ is firstly subjected to the inverse filter 9 with transfer function A(z), then to a filter 10 with transfer function $1/A(z/\gamma)$ where $\gamma$ denotes a predefined factor, generally of between 0.8 and 0.9. The combined filter thus constituted, with transfer function $W(z)=A(z)/A(z/\gamma)$, is a perceptual weighting for the residual error of the coder. The coefficients used in the filters 9 and 10 are the estimates $\hat{a}_i$ delivered by the short-term prediction unit 8.

The output R1 from the inverse filter 9 possesses long-term periodicity corresponding to the pitch of the speech. In the example considered, the corresponding filter is modelling by a transfer function of the form $1/B(z)$ with $B(z)=1-bz^{-T}$. The signal R1 is subjected to an inverse filter 11 with transfer function B(z) whose output R2 is delivered to the input of the filter 10. The output $S_W$ of the filter 10 thus corresponds to the input signal $S_i$ ridded of its long-term correlation by the filter 11 with transfer function B(z), and perceptually weighted by the filters 9, 10 with combined transfer function W(z).

The filter 11 comprises a subtractor whose positive input receives the signal R1 and whose negative input receives a long-term estimate obtained by delaying the signal R1 by T samples and amplifying it. The signal R1 and the long-term estimate are delivered to a unit 13 which maximises the correlation between these two signals in order to determine the delay T and the optimal gain b. The unit 13 explores all the integer and/or fractional values of the delay T between two bounds in order to select the one which maximises the normalised correlation. The gain b is deduced from the value of T and is quantised by discretization, this leading to a quantization value q(b); quantised value $\hat{b}$ corresponding to this quantization value q(b) is the one delivered as gain of the amplifier of the filter 11.

Speech synthesis within the coder is performed in a closed loop comprising an excitation generator 12, a filter 14 having the same transfer function as the filter 10, a correlator 15, and a unit 19 for maximizing the normalised correlation.

The nature of the excitation generator 12 makes it possible to distinguish between various types of analysis-by-synthesis coders, depending on the form of the excitation. Thus are distinguished the multipulse-excited linear prediction coding methods (MPLPC), an example of which is given in the document EP-A-0 195 487, and the code-excited linear prediction coding methods (CELP), which are reputed to have good performance when a low bit rate is required, an example of which is given in the article by Schroeder and Atal "Code Excited Linear Prediction (CELP): High Quality Speech At Very Low Bits Rates", Proc. ICASSP, March 1985, pp. 937–940. These various ways of modelling the excitation are usable in the scope of the present invention. Applicants have used excitation by regular pulse sequences, or RPCELP, such as described in European Patent Application No. 0 347 307. Being a CELP type coder, the excitation is represented by an input address k in a dictionary of excitation vectors, and by an associated gain G.

The selected and amplified excitation vector is subjected to the filter 14 with transfer function $1/A(z/\gamma)$, whose coefficients $\hat{a}_i$ ($1 \leqq i \leqq p$) are provided by the short-term unit 8. The resulting signal $S_W^*$ is delivered to an input of the correlator 15, whose other input receives the output signal $S_W$ from the filter 10. The output from the correlator 15 consists of the normalized correlation maximized by the unit 19, this amounting to minimizing the coding error. The unit 19 selects the address k and the gain G of the excitation generator which maximize the correlation arising from the correlator 15. Maximization consists in determining the optimal address k, the gain G being deduced from k. The unit 19 effects a quantization by discretization of the digital value of the gain G, this leading to a quantization value q(G). The quantized value $\hat{G}$ corresponding to this quantization value q(G) is the one which is delivered as gain of the amplifier of the excitation generator 12. The maximized correlation takes into account the perceptual weighting by the transfer function $W(z)=A(z)/A(z/\gamma)$, it being observed that this transfer function is applied to the input signal $S_I$ by the filters 9 and 10, as well as to the signal synthesized from the excitation vector, since the signal $S_W^*$ can be regarded as resulting from the amplified excitation vector to which are applied in succession the transfer functions $H(z)=1/A(z)$ of the short-term synthesis filter and $W(z)=A(z)/A(z/\gamma)$ of the perceptual weighting filter.

The excitation vector selected from the dictionary of the generator 12, the associated gain G, the parameters b and T of the long-term filter 13 and the coefficients $a_i$ of the short-term prediction filter, to which is appended a state bit Y which will be described further on, constitute the synthesis parameters whose quantization values k, q(G), q(b), T, q($a_i$), Y are dispatched to the receiver to allow the reconstruction of an estimate of the speech signal $S_I$. These quantization values are brought together on the same channel by the multiplexer 21 for dispatching.

The associated decoder illustrated in FIG. 1B comprises a unit 50 which restores the quantized values k, $\hat{G}$, T, $\hat{b}$, $\hat{a}_i$ on the basis of the quantization values received. An excitation generator 52 identical to the generator 12 of the coder receives the quantized values of the parameters k and G. The output $\hat{R}2$, of the generator 52 (which gives an estimate of R2) is subjected to the long-term prediction filter 53 with transfer function $1/B(z)$ whose coefficients are the quantized values of the parameters T and b. The output $\hat{R}1$ of the filter 53 (which is an estimate of R1) is subjected to the short-term prediction filter 54 with transfer function $1/A(z)$ whose coefficienes are the quantized values of the parameters $a_i$. The resulting signal $\hat{S}$ is the estimate of the input signal $S_I$ of the coder.

FIG. 2 shows an example of the construction of the short-term prediction unit 8 of the coder. The modelling coefficients $a_i$ are calculated for each frame, for example by the method of autocorrelations. The block 40 calculated the autocorrelations $$R(j)=\sum_{n=1}^{L-j} S_I(n)\times S_I(n+j)$$

for $0 \leqq j \leqq p$, R denoting the index of a sample from the current frame, and L the number of samples per frame. Conventionally, these autocorrelations allow recursive calculation of the optimal coefficients $a_i$ by means of the Levinson-Durbin algorithm (see J. Makhoul: "Linear Prediction: A Tutorial Review", Proc. IEEE, Vol. 63, No. 4, April 1975 pp. 561–580), which can be expressed as follows: E(O)=R(0) For i=1 to p do:

$$\begin{cases} k_i=\left[R(i)-\sum_{j=1}^{i-1} a_j^{(i-1)}R(i-j)\right]/E(i-1) \\ a_i^{(i)}=k_i \\ E(i)=(1-k_i^2)E(i-1) \\ a_j^{(i)}=a_j^{(i-1)}-k_i a_{i-j}^{(i-1)} \qquad \text{for } 1 \leqq j \leqq i-1 \end{cases}$$

The final solution obtained by the block 41 is given by: $a_i=a_i^{(p)}$ for $1 \leqq i \leqq p$. In the above algorithm, the quantity E(p)

is the residual error of the linear prediction, and the quantities $k_i$, lying between −1 and +1, are called the reflection coefficients.

With a view to transmitting the coefficients obtained, they can be represented by various parameters to be quantized: the prediction coefficients themselves $a_i$, the reflection coefficients $k_i$, or else the log-area ratios LAR given by:

$$LAR_i=\log_{10}[(1+k_i)/(1-k_i)]$$

The representation parameters thus obtained are quantized to reduce the number of bits required in their identification.

The invention proposes to determine the spectral state of the speech signal from among a first state $Y_A$ (Y=0, IRS type) and a second state $Y_B$ (Y=1, linear type) which are such that the signal contains proportionally less energy in the low frequencies when in the state $Y_A$ than when in the state $Y_B$, and to apply one or the other of two distinct modes of quantization to obtain the quantization values of the coefficients of the short-term synthesis filter depending on the determined spectral state.

In FIG. 3, the two solid lines correspond to the bounding of the IRS template defined for microphones in Recommendation P48 of the CCITT. It is seen that an IRS type microphone signal exhibits strong attenuation in the lower part of the spectrum (between 0 and 300 Hz) and a relative emphasis in the high frequencies. By comparison, a signal of linear type, delivered for example by the microphone of a hands-free installation, exhibits a flatter spectrum, in particular not having the strong attenuation at low frequencies (a typical example of such a signal of linear type is illustrated by a dashed line in the chart of FIG. 3).

Figure 4:
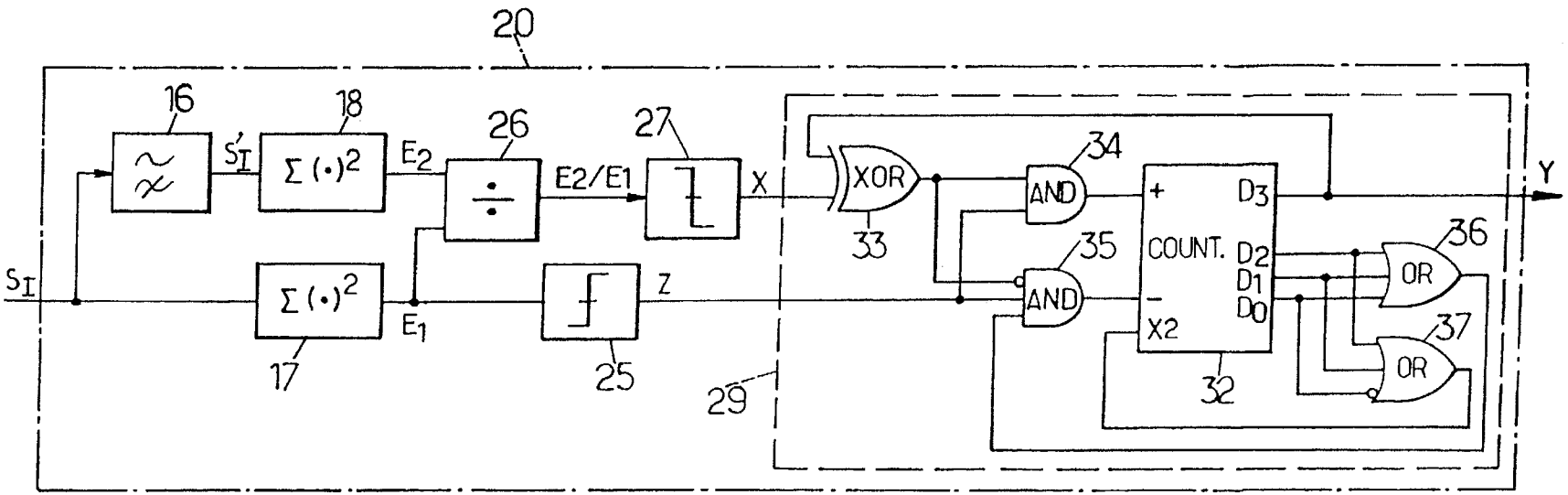
FIG. 4 is a diagram of a device for detecting the spectral state of the signal, useable with the coder of FIG. 1A.

The detection device 20, represented in FIG. 1A and detailed in FIG. 4, which delivers frame by frame the state bit Y, takes advantage of these spectral properties.

The detection device 20 comprises a high-pass filter 16 receiving the input acoustic signal $S_I$ and delivering the filtered signal $S_I'$. The filter 16 is typically a digital filter of bi-quad type having an abrupt cut-off at 400 Hz. The energies E1 and E2 contained in each frame of the input acoustic signal $S_I$ and of the filtered signal $S_I'$ are calculated by two units 17, 18 each forming the sum of the squares of the samples of each frame which it receives.

The energy E1 of each frame of the input signal $S_I$ is addressed to the input of a threshold comparator 25 which delivers a bit Z of value 0 when the energy E1 is below a predetermined energy threshold, and of value 1 when the energy E1 is above the threshold. The energy threshold is typically of the order of −38 dB with respect to the saturation energy of the signal. The comparator 25 serves to inhibit the determination of the state of the signal when the latter contains two little energy to be representative of the characteristics of the source. In this case, the determined state of the signal remains unchanged.

The energies E1 and E2 are addressed to the digital divider 26 which calculates the ratio E2/E1 for each frame. This ratio E2/E1 is addressed to another threshold comparator 27 which delivers a bit X of value 0 when the ratio E2/E1 is above a predetermined threshold, and of value 1 when the ratio E2/E1 is below the threshold. This threshold on the ratio E2/E1 is typically of the order of 0.3. The bit X is representative of a condition of the signal in each frame. The condition X=0 corresponds to the IRS characteristics of the input signal (state $Y_A$), and the condition X=1 corresponds to the linear characteristic (state $Y_B$). To avoid repeated and spurious changes of state in the event of short-term variations in the voice excitation, the state bit Y is not taken directly equal to the condition bit X but results from a processing of the successive condition bits X by a state determination circuit 29.

Figure 5:
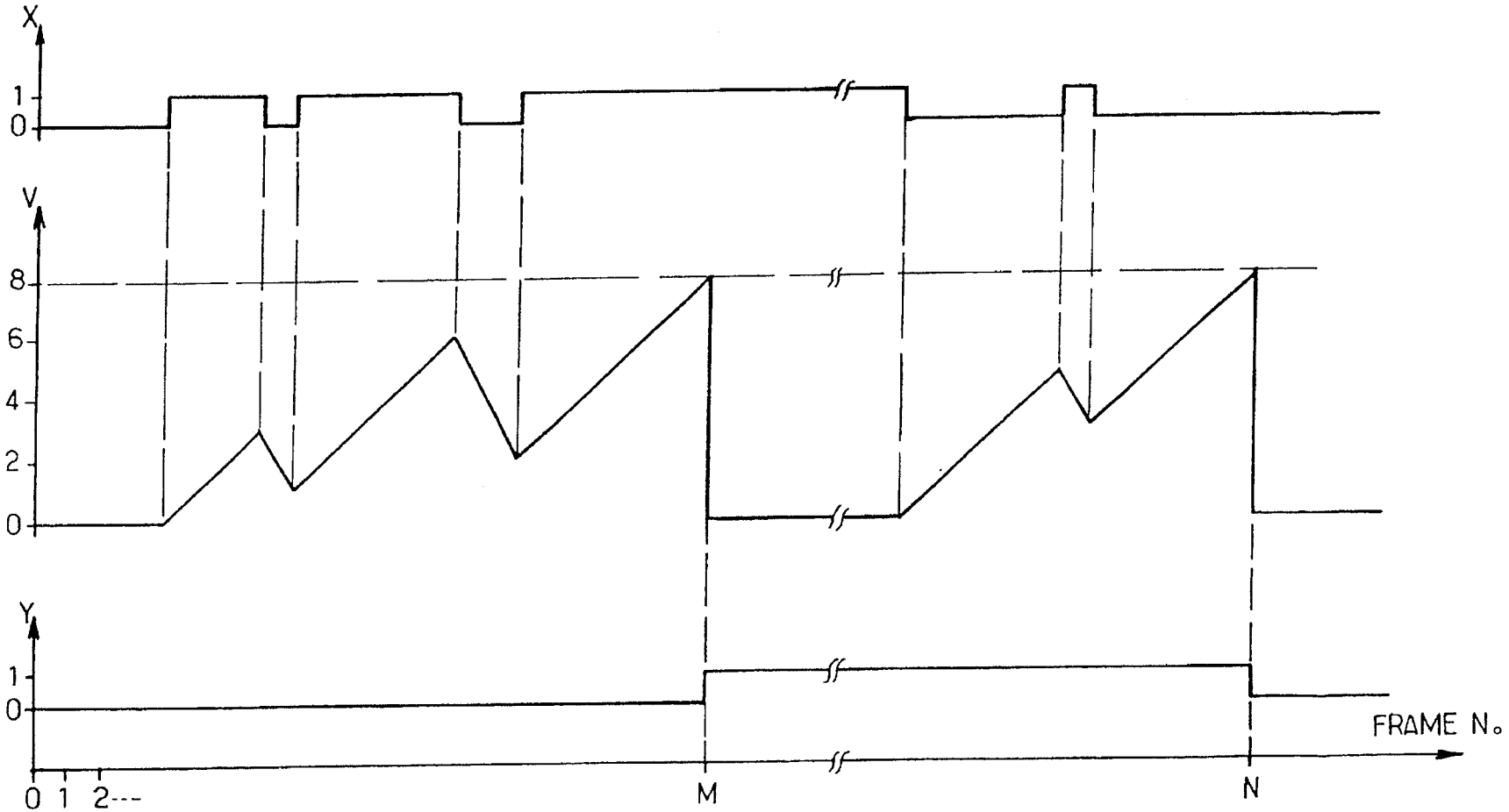
FIG. 5 shows timing diagrams illustrating the way of detecting the state of the signal via the device of FIG. 4.

The operation of the state determination circuit 29 is illustrated in FIG. 5 where the upper timing diagram illustrates an example of the evolution of the bit X provided by the comparator 27. The state bit Y (lower timing diagram) is initialized to 0, since the IRS characteristics are encountered most frequently. A counting variable V, initially set to 0, is calculated frame after frame. The variable V is incremented by one unit each time that the condition X of the signal in a frame differs from that corresponding to the determined state Y (X=1 and Y=0, or X=0 and Y=1). In the contrary case (X=Y=0 or 1) the variable V is decremented by two units if it is different from 0 and from 1, decremented by one unit if it is equal to 1, and held unchanged if it is equal to 0. Once the variable V reaches a predetermined threshold (8 in the example considered), it is reset to 0 and the value of the bit Y is changed, so that the signal is determined to have changed state. Thus, in the example represented in FIG. 1, the signal is in the state $Y_A$ up to frame M, in the state $Y_B$ between frames M and N (change of signal source), then again in the state $Y_A$ onwards of frame N. Of course, other ways of incrementing and decrementing and other threshold values would be usable.

The above counting mode can for example be obtained by the circuit 29 represented in FIG. 4. This circuit comprises a counter 32 on four bits, of which the most significant bit corresponds to the state bit Y, and the three least significant bits represent the counting variable V. The bits X and Y are delivered to the input of an EXCLUSIVE OR gate 33 whose output is addressed to incrementation input of the counter 32 via an AND gate 34 whose other input receives bit Z provided by the threshold comparator 25. Thus, the variable V is incremented when X≠Y and Z=1. The inverted output from the gate 33 is delivered to a decrementation input of the counter 32 via another AND gate 35 whose other two inputs respectively receive the bit Z provided by the comparator 25, and the output from an OR gate 36 with three inputs receiving the three least significant bits of the counter 32. The counter 32 is configured to double the pulses received on its decrementation input when its least significant bit equals 0 or when at least one of the two following bits equals 1, as shown diagrammatically by the OR gate 37 in FIG. 4. Thus, the counter 32 is decremented (by one unit if V=1 and by two units if V>1) when X=Y and Z=1 and V≠0. When the energy of the input signal is insufficient, we have Z=0 and the determination circuit 29 is not activated since the AND gates 34, 35 prevent modification of the value of the counter 32.

The state bit Y thus determined is delivered to the short-term linear prediction unit 8 in order to choose the mode for quantizing the coefficients of the short-term synthesis filter.

In the preferred example illustrated in FIG. 2, the parameters used to represent the coefficients $a_i$ of the short-term synthesis filter are the line spectrum frequencies (LSF), or line spectrum pairs (LSP). These parameters are known to have good statistical properties and readily to ensure the stability of the synthesized filter (see N. Sugamura and F. Itakura: "Speech Analysis And Synthesis Method Developed At ECL in NTT: From LPC to LSP", Speech Communication, North Holland, Vol. 5, No. 2, 1986, pp. 199–215). The LSP parameters are obtained from polynomials Q(z) and Q*(z) defined below:

$$Q(z)=A(z)+z^{-(p+1)}\times A(z^{-1})$$

$$Q^*(z)=A(z)-z^{-(p+1)}\times A(z^{-1})$$

It can be proven that the complex roots of these two polynomials are on the unit circle and that, on travelling round the unit circle, the roots of Q(z) alternate with those of Q*(z). The p roots other than z=+1 and z=1 can be written $e^{2\pi j f_i}$ with $j^2=-1$, the p frequencies $f_i$ being defined as the line spectrum frequencies normalized relative to the sampling frequency. The normalized frequencies $f_i$ lie between 0 and 0.5 and are ordered in such a way that each pair of consecutive frequencies comprises a frequency corresponding to a root of Q(z) and a frequency corresponding to a root of Q*(z). In this modelling, the line spectrum frequencies of a pair bracket a formant of the speech signal and their distance apart is inversely proportional to the amplitude of the resonance of this formant. The LSP parameters are calculated by the block 42 from the prediction coefficients $a_i$ obtained by the block 41 by means of the Chebyshev polynomials (see P. Kabal and R. P. Ramachandran: "The Computation of Line Spectral Frequencies Using Chebyshev Polynomials", IEEE Trans. ASSP, Vol. 34, No. 6, 1986, pp. 1419–1426). They may also be obtained directly from the autocorrelations of the signal, by the split Levinson algorithm (see P. Delsarte and Y. Genin: "The Split Levinson Algorithm", IEEE Trans. ASSP, Vol. 34, No. 3, 1986).

The block 43 performs the quantization of the LSF frequencies, or more precisely of the values $\cos 2\pi f_i$, hereafter referred to as the LSP parameters, lying between −1 and +1, which simplifies the problems of dynamic range. The process for calculating the LSF frequencies makes it possible to obtain them in the order of ascending frequencies, that is to say of descending cosines.

There are, in respect of these LSP parameters, two large families of quantization processes: scalar quantization in which each parameter is represented separately by the closest quantized value; and vector quantization, which is performed on one or more groups of parameters, in respect of each of which the nearest vector is searched for in a multidimensional dictionary.

In the case of vector quantization in respect of LPC analysis of order p=10, there are performed for example m=3 independent vector quantizations, with respect dimensions 3,3 and 4, defining the LSP groups I(1,2,3), II(4,5,6) and III(7,8,9,10). Each group is quantized by selecting from a prerecorded respective quantization table a vector exhibiting the minimum euclidian distance from the parameters of this group.

For group I, two disjoint quantization tables $T_{I,1}$ and $T_{I,2}$ of respective sizes $2^{n1}$ and $2^{n2}$ are defined. For group II, two quantization tables $T_{II,1}$ and $T_{II,2}$ of respective sizes $2^{p1}$ and $2^{p2}$ are defined, having a common part in order to reduce the necessary memory space. For group III, a single quantization table $T_{III}$ of size $2^q$ is defined. The addresses $AD_I$, $AD_{II}$, $AD_{III}$ of the three vectors arising from three quantization tables relative to the three groups constitute the quantization values $q(a_i)$ of the coefficients of the short-term synthesis filter, which are addressed to the multiplexer 21. The block 43, which effects quantization of the LSP parameters, selects the tables $T_{I,1}$ and $T_{II,1}$ to search for the quantization vectors for groups I and II when Y=0 (signal of IRS type). Consequently, the samples of the tables $T_{I,1}$ and $T_{II,1}$ are constructed in such a way that their statistics are optimized in respect of the quantization of a signal of IRS type. When Y=1 (linear state), the block 43 selects the tables $T_{I,2}$ and $T_{II,2}$, whose statistics are designed to be representative of an input signal of linear type. For group III, table $T_{III}$ is used in all cases, since the high part of the spectrum is less sensitive to the differences between the IRS and linear characteristics. The state bit Y is additionally delivered to the multiplexer 21.

A unit 45 calculates the estimates $\hat{a}_i$ from the discretized values of the LSP parameters given by the free vectors picked. The LSP parameters $\cos 2\pi f_i$ make it possible readily to determine the coefficients of the short-term synthesis filter, given that $$Q(z) = (1+z^{-1}) \prod_{i=1,3,\ldots,p-1} (1-2\cos(2\pi f_i)z^{-1}+z^{-2});$$

$$Q^*(z) = (1-z^{-1}) \prod_{i=1,3,\ldots,p} (1-2\cos(2\pi f_i)z^{-1}+z^{-2});$$

and $$A(z) = [Q(z)+Q^*(z)]/2$$

The estimates $\hat{a}_i$ thus obtained are delivered by the unit 45 to the short-term filters 9, 10 and 14 of the coder. In the decoder, the same calculation is performed by the restoring unit 50, the vectors of quantized cosines being retrieved from the quantization addresses $AD_I$, $AD_{II}$ and $AD_{III}$. The decoder contains the same quantization tables as the coder, and their selection is performed as a function of the state bit Y received.

Apart from the optimization of the performance of the coder, the use of two families of quantization tables selected according to the spectral state Y has the advantage of achieving better effectiveness in terms of number of coding bits required. Indeed, the total number of bits used, for equal performance, for quantization of the LSP parameters in each case is less than the number of bits necessary when a single family of tables is used independently of detection of the spectral state. In the typical case where n1=8, n2=7, p1=9, p2=10 and q=8, the number of bits necessary for coding the LSP parameters equals n1+p1+q+1=26 when Y=0, and n2+p2+q+1=26 when Y=1 (this ensuring the same global bit rate), whereas obtaining as ample a statistic without calling upon the state Y would require at least n+p+q=10+11+8=29 addressing bits.

As a variant, the block 43 can be configured to perform differential vector quantization. Each parameter group I, II, III is then quantized differentially relative to a mean vector. For group I, two distinct mean vectors $V_{I,1}$ and $V_{I,2}$ and a quantization table for the differences $TD_I$ are defined. For group II, two distinct mean vectors $V_{II,1}$ and $V_{II,2}$ and a quantization table for the differences $TD_{II}$ are defined. For group III, two distinct mean vectors $V_{III,1}$ and $V_{III,2}$ and a quantization table for the differences $TD_{III}$ are defined. The mean vectors $V_{I,1}$ and $V_{II,1}$ are set up so as to be representative of a statistic of signals of IRS type, whereas the mean vectors $V_{I,2}$ and $V_{II,2}$ are set up so as to be representative of a statistic of signals of linear type. The block 43 effects the differential quantization of the groups I and II relative to the vectors $V_{I,1}$ and $V_{II,1}$ when Y=0 (IRS state) and relative to the vectors $V_{I,2}$ and $V_{II,2}$ when Y=1 (linear state). The advantage of this differential quantization is that it makes it possible to store, in the coder and in the decoder, only one quantization table per group. The quantization values $q(a_i)$ are the addresses of the three optimal difference vectors in the three tables, to which is appended the bit Y determining which are the mean vectors to be added to these difference vectors in order to restore the quantized LSP parameters.

When proceeding with scalar quantization, each parameter is represented separately by the closest quantized value. For each LSP parameter $\cos 2\pi f_i$ an upper bound $m_i$ and a lower bound $M_i$ are defined such that, over a large number of speech samples, around 90% of the encountered values of $\cos 2\pi f_i$ lie between $m_i$ and $M_i$. The reference interval between the two bounds is divided into $2^{Ni}$ equal segments, where Ni is the number of coding bits devoted to the quantizing of the parameter $\cos 2\pi f_i$. After having quantized the first LSP parameter $\cos 2\pi f_1$, the ordering property of frequencies $f_i$ is used to replace in some cases the upper bound $M_i$ by the quantized value of the preceding cosine $\hat{c}os 2\pi f_{i-1}$. In other words, for $1<i\leqq p$, the quantization of $\cos 2\pi f_i$ is performed by subdividing the interval of variation $[m_i, \min\{M_i, \hat{c}os 2\pi f_{i-1}\}]$ into $2^{Ni}$ equal segments. Quantization of a LSP parameter $\cos 2\pi f_i$ within its interval of variation consists in determining the number $n_i$ of Ni bits such that $\cos 2\pi f_i$ is in the $n_i$-th segment of the reference interval (if $\cos 2\pi f_i < m_i$, we take $n_i = 1$).

Detection of the spectral state of the signal makes it possible to define two families of reference intervals $[m_{i,1}, M_{i,1}]$ and $[m_{i,2}, M_{i,2}]$ for the first r parameters ($1\leqq i\leqq r\leqq p$). The family $[m_{i,1}, M_{i,1}]$ is set up statistically from samples of signals of IRS type, and is selected for effecting the quantization when Y=0 (IRS state). The family $[m_{i,2}, M_{i,2}]$ is set up statistically from samples of signals of linear type and is selected for effecting the quantization when Y=1 (linear state). These two families are stored in memory in both the coder and the decoder.

Another possibility, which may supplement or replace the previous one, consists in defining, for some of the parameters, different numbers of coding bits Ni according as the signal is of IRS or linear type. For the same total number of coding bits, it is possible in particular to take smaller numbers Ni in the IRS case than in the linear case for the first LSP parameters (the largest cosines), given that the dynamic range of the first LSP parameters is reduced in the IRS case, the decrease in the first Ni) values being compensated by an increase in the Ni values relating to the last LSP parameters, thus increasing the fineness of quantization of these last parameters. These various allocations of coding bits are stored in memory in both the coder and the decoder, the LSP parameters thus being retrievable by examining the state bit Y.

As a replacement for or complement of the device 20, the calculated LSP parameters can be put to use to determine which is the spectral state Y of the input signal. This is illustrated by the block 44 in FIG. 2. The line spectrum frequencies of each pair bracket a formant of the speech signal, and their distance apart is inversely proportional to the amplitude of the resonance. It is seen that in this way the LSP parameters may directly yield a fairly precise surmise of the spectral envelope of the speech signal. In the case of a signal of IRS type, the amplitude of the resonances situated in the lower part of the spectrum is smaller than in the linear case. Thus, by analyzing the gaps between the first consecutive LSF frequencies, it is possible to determine whether the input signal is rather of IRS type (large gaps) or linear type (smaller gaps). This determination can be performed for each signal frame so as to obtain the condition bit X which is then processed by a state determination circuit similar to the circuit 29 of FIG. 4 to obtain the state bit Y used by the quantization block 43.

We claim:

1. Linear prediction speech coding method, in which a speech signal digitized as successive frames is subjected to analysis-by-synthesis in order to obtain, for each frame, quantization values of synthesis parameters allowing reconstruction of an estimate of the speech signal, and said quantization values are dispatched, the analysis-by-synthesis comprising short-term linear prediction of the speech signal in order to determine the quantization values of the coefficients of a short-term synthesis filter, said method further comprising determining a spectral state of the speech signal from among first and second states such that the signal contains proportionally less energy at the low frequencies in the first state than in the second state; and applying one or the other of two modes of quantization to obtain the quantization values of the coefficients of the short-term synthesis filter depending on the determined spectral state of the speech signal.

2. Method according to claim 1, wherein the determined state of the speech signal is not modified when the speech signal has energy below a predetermined threshold.

3. Method according to claim 1 wherein the determination of the spectral state of the speech signal comprises the steps of:

detecting frame-by-frame whether the speech signal is in a first condition corresponding to the first spectral state or in a second condition corresponding to the second spectral state;

determining the spectral state of the speech signal on the basis of the frame-by-frame conditions, by modifying the determined spectral state only after several successive frames show a signal condition different from that corresponding to the previously determined spectral state.

4. Method according to claim 3, comprising the steps of:

incrementing a counting variable when the condition of the signal in a frame differs from that corresponding to the determined spectral state of the speech signal;

decrementing said counting variable when the condition of the signal in a frame is that corresponding to the determined spectral state of the speech signal unless said counting variable equals zero; and when the counting variable reaches a predetermined threshold, resetting said counting variable to zero and determining that the spectral state of the speech signal has changed.

5. Method according to claim 3, wherein the determination of the spectral state of the speech signal comprises the steps of :

high-pass filtering the speech signal; and comparing the energy of the high-pass filtered signal with the energy of the unfiltered speech signal in order to determine frame-by-frame whether the speech signal is in the first condition, for which the energy of the high-pass filtered signal is above a predetermined fraction of the energy of the unfiltered speech signal, or in the second condition, for which the energy of the high-pass filtered signal is below the predetermined fraction of the energy of the unfiltered speech signal.

6. Method according to claim 3, comprising:

representing the coefficients of the short-term synthesis filter by a set of line spectrum frequencies; and analyzing the distribution of the line spectrum frequencies in each frame of the speech signal in order to detect whether the signal is in the first or the second condition.

7. Method according to claim 1, comprising:

representing the coefficients of the short-term synthesis filter by a set of p ordered line spectrum frequency parameters, subdivided into m groups of consecutive frequency parameters, p being the order of the short-term linear prediction and m being an integer greater than or equal to 1; and differentially quantizing at least the first group relative to a mean vector chosen from a pair of distinct vectors depending on the determined spectral state of the speech signal.

8. Method according to claim 7, wherein the number m is equal to 3, and wherein each of the first two groups of consecutive frequency parameters is quantized differentially relative to a respective mean vector chosen from a respective pair of distinct vectors depending on the determined spectral state of the speech signal.

9. Method according to claim 1, comprising:

representing the coefficients of the short-term synthesis filter by a set of p ordered line spectrum frequency parameters, subdivided into m groups of consecutive frequency parameters, p being the order of the short-term linear prediction and m being an integer greater than or equal to 1; and quantizing at least the first group by selecting from a quantization table a vector exhibiting a minimum distance from the frequency parameters of said group, said quantization table being chosen from a pair of distinct tables depending on the determined spectral state of the speech signal.

10. Method according to claim 9, wherein the number m is equal to 3, and wherein each of the first two groups of consecutive frequency parameters is quantized by selecting from a respective quantization table a vector exhibiting a minimum distance from the frequency parameters of said group, each of the two quantization tables relative to the first two groups being chosen from a respective pair of distinct tables depending on the determined spectral state of the speech signal.

11. Method according to claim 10, wherein the pair of distinct quantization tables relative to the first group are disjoint, and wherein the pair of distinct quantization tables relative to the second group exhibit a common part.

12. Method according to claim 1, comprising:

representing the coefficients of the short-term synthesis filter by a set of p ordered line spectrum frequency parameters, p being the order of the short-term linear prediction; and quantizing each of said p parameters by subdividing an interval of variation included within a respective reference interval into $2^{Ni}$ segments, Ni being a number of coding bits devoted to the quantizing of said parameter, whrerein, at least for the first ordered parameters, reference intervals are used, each chosen from a respective pair of distinct intervals depending on the determined spectral state of the speech signal.

13. Method according to claim 1, comprising:

representing the coefficients of the short-term synthesis filter by a set of p ordered line spectrum frequency parameters, p being the order of the short-term linear prediction; and quantizing each of said p parameters by subdividing an interval of variation included within a respective reference interval into $2^{Ni}$ segments, Ni being a number of coding bits devoted to the quantizing of said parameter, wherein some at least of the numbers of coding bits Ni are given one or other of two respective distinct values depending on the determined spectral state of the speech signal.

* * * * *